US006186251B1

(12) United States Patent
Butcher

(10) Patent No.: US 6,186,251 B1
(45) Date of Patent: Feb. 13, 2001

(54) METHOD OF ALTERING A BALANCE CHARACTERISTIC AND MOMENT CONFIGURATION OF A DRILL BIT AND DRILL BIT

(75) Inventor: Trent N. Butcher, Sandy, UT (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/123,167

(22) Filed: Jul. 27, 1998

(51) Int. Cl.[7] ..... E21B 10/60
(52) U.S. Cl. ..... 175/393; 175/340
(58) Field of Search ..... 175/393, 400, 175/424, 339, 340; 239/390, 397, 380, 251, 587.1, 587.4; 73/152.49, 152.56

(56) References Cited

U.S. PATENT DOCUMENTS

| | | | | |
|---|---|---|---|---|
| 3,137,354 | | 6/1964 | Crawford et al. . | |
| 3,261,413 | * | 8/1999 | Kistler, Jr. | 175/317 |
| 3,488,765 | | 1/1970 | Anderson . | |
| 3,645,346 | * | 2/1972 | Miller et al. | 175/237 |
| 4,533,005 | | 8/1985 | Morris . | |
| 4,640,375 | * | 2/1987 | Barr et al. | 175/410 |
| 4,794,995 | | 1/1989 | Matson et al. . | |
| 4,932,484 | | 6/1990 | Warren et al. . | |
| 4,982,802 | | 1/1991 | Warren et al. . | |
| 5,010,789 | | 4/1991 | Brett et al. . | |
| 5,042,596 | | 8/1991 | Brett et al. . | |
| 5,090,491 | | 2/1992 | Tibbitts et al. . | |
| 5,096,005 | | 3/1992 | Ivie et al. . | |
| 5,099,929 | | 3/1992 | Keith et al. . | |
| 5,099,934 | | 3/1992 | Barr . | |
| 5,109,935 | | 5/1992 | Hawke . | |
| 5,111,892 | | 5/1992 | Sinor et al. . | |
| 5,119,892 | | 6/1992 | Clegg et al. . | |
| 5,131,478 | | 7/1992 | Brett et al. . | |
| 5,165,494 | | 11/1992 | Barr . | |
| 5,178,222 | | 1/1993 | Jones et al. . | |
| 5,186,268 | | 2/1993 | Clegg . | |
| 5,213,168 | * | 5/1993 | Warren et al. | 175/61 |
| 5,314,030 | * | 5/1994 | Peterson et al. | 175/26 |
| 5,433,280 | | 7/1995 | Smith . | |
| 5,544,550 | | 8/1996 | Smith . | |
| 5,551,522 | | 9/1996 | Keith et al. . | |
| 5,582,261 | | 12/1996 | Keith et al. . | |
| 5,607,024 | | 3/1997 | Keith et al. . | |
| 5,607,025 | | 3/1997 | Mensa-Wilmot et al. . | |
| 5,655,614 | | 8/1997 | Azar . | |
| 5,669,459 | | 9/1997 | Larsen et al. . | |
| 5,934,389 | * | 8/1999 | Ramsey et al. | 175/57 |

* cited by examiner

*Primary Examiner*—William Neuder
*Assistant Examiner*—Zakiya Walker
(74) *Attorney, Agent, or Firm*—Trask Britt

(57) ABSTRACT

A method of altering the force balance characteristic or moment configuration of an earth-boring rotary-type drill bit by altering the net hydraulic direction vector of drilling fluid exiting from the drill bit and, therefore, the accompanying net hydraulic force exerted on the drill bit. The method includes replacing at least one nozzle of the drill bit with a differently sized nozzle to alter the amount of hydraulic force that is exerted on a particular portion of the drill bit. Alternatively, the orientation of at least one nozzle of the drill bit may be changed to alter the direction in which drilling fluid flows from a particular portion of the drill bit and, thus, alter the direction of the hydraulic force on the drill bit. The method may be employed to counteract a net force imbalance of a drill bit, to alter a direction of net force imbalance, or to vary the magnitude of net force imbalance.

31 Claims, 10 Drawing Sheets

METHOD OF ALTERING A BALANCE CHARACTERISTIC AND MOMENT CONFIGURATION OF A DRILL BIT AND DRILL BIT

BACKGROUND OF THE INVENTION

1. Field of the Invention

The present invention relates to rotary-type drill bits for use in subterranean drilling. Particularly, the present invention relates to rotary-type earth-boring drill bits that employ hydraulics to at least partially achieve or tailor a desired lateral force balance or net force imbalance characteristic or moment configuration.

2. Background of Related Art

Fixed cutter rotary drag bits for subterranean earth-boring have been employed for decades. It has been found that increasing the rotational speed of such a drill bit, for a given weight on bit, increases the rate of penetration of the drill bit. Increasing the rotational speed of a drill bit, however, may tend to prematurely damage or destroy the cutting elements of the drill bit, which decreases the useful life thereof.

It has been recognized that cutting element destruction, particularly at higher drill bit rotational speeds, is at least in part attributable to a phenomenon known as "whirl" or "bit whirl". Radially directed centrifugal imbalance forces (i.e. transverse to the axis of the drill bit) exist to some extent in every rotating drill bit and drill string. Such forces are attributable in part to mass imbalance and in part to dynamic forces generated by contact of the drill bit with the formation. In the latter instance, aggressive cutting element placement and orientation creates a high tangential cutting force relative to the ordinary force of a rotating bit and aggravates the imbalance. In any event, these imbalance forces tend to cause the drill bit to rotate or "roll" about the borehole in a direction counter to the normal direction of rotation imparted to the bit during drilling. This counter-rotation is termed "whirl", and is a self-propagating phenomenon, as the side or transverse forces on the bit cause its center of rotation to shift to one side, after which there is an immediate tendency to shift again. Since cutting elements are designed to cut and to resist impact received in the ordinary direction of bit rotation (clockwise, looking down), whirl-induced contact of the cutting elements with the borehole wall in a counter-clockwise direction places stresses on the cutting elements for which they were never designed, and may damage or destroy the cutting elements, which decreases the effective life of the drill bit.

Balancing the transverse forces acting on rotary-type drill bits during operation has proven to be extremely important to their performance. Drilling forces influence dynamic behavior such as whirl, steerability, and bit walk. Both balanced force and net force imbalance drill bits have been developed to counteract the tendency of a drill bit to whirl.

In many conventional balanced rotary-type earth-boring drill bits, the various components, such as the blades and cutting elements, are designed and oriented in a manner which balances the forces acting on the drill bit and reduces the tendency of the drill bit to whirl when rotated at high speeds and under a low weight on bit (WOB).

Rotary-type earth-boring drill bits which have a net transverse imbalance force during the rotation thereof have also been designed in order to reduce or eliminate bit whirl. Such drill bits are designed to focus or direct the imbalance forces, which typically cause bit whirl, to a particular side of the bit. Typically, the cutting elements and mass of the bit are positioned in a manner that causes the bit to ride on a low friction bearing zone or pad on the gage of the side of the bit to which the imbalance forces are focused, thus substantially reducing the drill bit/borehole wall tangential forces which typically induce whirl. This solution is disclosed in U.S. Pat. Nos. 4,982,802, 5,010,789 and 5,042,596, each of which are assigned to Amoco Corporation of Chicago, Ill. The magnitude of net transverse imbalance forces that are focused toward the low friction bearing zone may, however, be more than adequate to maintain contact of the low friction bearing zone of the drill bit with the formation. Consequently, an excessive net imbalance force may cause the low friction bearing zone to wear prematurely and therefore shorten the useful life of the drill bit.

While the forces of the drill bit against a rock formation and the consequent effect of such forces on the drill bit, as well as the positioning of various components on the drill bit, are typically considered during the design of both balanced and net imbalance rotary-type earth-boring drill bits, the designs of conventional rotary-type drill bits do not account for the hydraulic force of drilling fluid that flows through and out of the drill bit.

Both balanced and net imbalance drill bits include nozzles through which drilling fluid, such as "mud", air, gases or gas mixtures, foam, or other fluid media that may be employed during drilling of a formation, flows. Drilling fluid is typically used during drilling in order to cool and lubricate the face of the drill bit and the cutting elements thereon, to remove debris from the bit face and transport same up the borehole, and to prevent the introduction of pressurized gases or liquids from the drilled formation into the borehole, which may otherwise result in a "blowout" of the borehole.

As drilling fluid flows through the drill bit the hydraulic forces of the drilling fluid affect the rotational balance of the drill bit. The hydraulic forces of drilling fluid on a rotary type drill bit are similar to the force that occurs as water flows through and out of a garden hose or fire hose. In rotary-type drill bits, hydraulic forces will affect the rotational balance of the bit as the drilling fluid moves through the bit, accelerates, and exits the bit through the nozzles. Typically, the nozzles of a drill bit are fixed in orientation; thus, drilling fluid exits the bit through each nozzle in a fixed direction.

Hydraulic forces can have a substantial effect on the balance or net imbalance of a rotary-type drill bit due to the typically high density of drilling fluid and the typically high flow rates of drilling fluid through the bit during drilling. The line graphs of FIGS. 1 and 2 illustrate the amount of hydraulic force that is exerted on a drill bit as drilling fluid having a weight of 12 lbs/gallon flows at a given rate (typically measured in gallons per minute, or "GPM") through variously sized nozzles of the drill bit. For example, about 20,000 net pounds of force is exerted on a drill bit having four 8/32 inch nozzles as 12 lbs/gallon mud flows therethrough at a rate of 320 GPM. As another example, about 5,000 pounds of force would be exerted on a drill bit including four 15/32 inch nozzles as 12 lbs/gallon mud flows therethrough at a rate of 320 GPM. Thus, since drilling fluid typically exits the drill bit under high flow rates and in a fixed direction, the balance of the drill bit may be undesirably affected, which may induce whirl in balanced force or net imbalance force drill bits which are otherwise designed to prevent this phenomenon, or alter the amount or direction of net imbalance of a net imbalance force drill bit so as to orient the force in a direction so that the bit does not ride on its bearing surface or pad.

Accordingly, a rotary-type drill bit is needed in which hydraulic forces may be utilized to provide a desired amount of force balance or net force imbalance characteristic of the drill bit. A system for altering or tailoring the overall balance of a rotary-type drill bit is also needed.

SUMMARY OF THE INVENTION

The rotary-type drill bit of the present invention addresses the foregoing needs.

In the design and use of the rotary-type drill bit of the present invention, the effects of the weight of drilling fluid, the size of each nozzle, the placement of each nozzle on the drill bit, the direction in which drilling fluid exits each nozzle, the rate at which drilling fluid will be introduced into a borehole, and the effect on the drill bit of directing drilling fluid against the borehole wall or end face being drilled are each considered in utilizing the drill bit hydraulics to impart the drill bit with a desired balance characteristic or moment configuration.

"Moment" is force acting at a distance. The moment configuration of a drill bit is the overall moment thereof. With reference to FIG. 3, the moment configuration and balance characteristic of a so-called balanced force drill bit 1 are illustrated. Drill bit 1 includes nozzles 2 from each of which a jet 3 of a drilling fluid material may be directed. The hydraulic direction vector 4, or line of action, of each jet of drilling fluid exerts a reactive, hydraulic force on the drill bit 1. Other factors, such as the size, location and configuration of various other elements of drill bit 1, such as the blades, lateral bearing surfaces, and cutting elements thereof, may also affect the balance characteristic or moment configuration of the drill bit. The moment of drill bit 1 may be determined by summing the products of the force of each jet 3 multiplied by the length of each moment arm 5, which is the distance between the axis 6 of drill bit 1 and the corresponding hydraulic direction vector 4, perpendicular to the line of action. Although FIG. 3 illustrates forces in the X-Y plane, drilling fluid may also affect the balance or moment of the drill bit in other planes (i.e., along the z-axis).

Accordingly, the rotary-type drill bit of the present invention includes nozzles that are sized, positioned and oriented on the drill bit to impart the drill bit with the desired balance characteristic during use with a particular weight and flow rate of drilling fluid. Both balanced and net imbalance drill bits which utilize drill bit hydraulics in such a manner are within the scope of the present invention. Moreover, the hydraulics of the drill bit may be tailored to provide the drill bit with a desired net imbalance direction and magnitude, or net hydraulic force vector, which is substantially opposite the collective hydraulic direction vector of drilling fluid flowing from the drill bit, in order to tailor the balance characteristic or moment configuration of the drill bit. In tailoring the drill bit hydraulics, an initial moment configuration, which is based on the number, size, location and orientation of the cutting elements and the number, size, location and configuration of the blades and lateral bearing surfaces of the drill bit is compared with a moment configuration that is desired of the drill bit, which is also referred to as a desired moment configuration. Other factors, including, without limitation, the weight and flow rate of drilling fluid to be used with the drill bit, may also affect the balance or moment of the bit. The nozzles of the drill bit are then positioned, appropriately sized, or adjusted in orientation so that the hydraulic forces of drilling fluid flowing therethrough adjust the moment configuration of the drill bit from the initial moment configuration to the desired moment configuration. Similarly, fixed operational parameters or ranges thereof (e.g., drilling fluid weight, flow rate, WOB, etc.) that facilitate the desired balance or moment may be determined.

A drill bit of the present invention may include one or more removable nozzles. Accordingly, the nozzles of the drill bit may be replaced with larger or smaller nozzles in order to vary the hydraulic force exerted on the drill bit by drilling fluid that flows therefrom and to exert a desired amount of hydraulic force on the drill bit at the location of the nozzle. Similarly, a drill bit of the present invention may include one or more nozzles that may be oriented in a plurality of directions. Such nozzles permit variation in the orientation of the hydraulic direction and hydraulic force vectors.

A process of altering the balance of a drill bit is also within the scope of the present invention. The direction of net imbalance forces may be altered or net imbalance forces substantially eliminated by replacing one or more nozzles of the drill bit with a nozzle of a different size and, thus, relative flow rate. Alternatively, the overall balance characteristic or moment configuration of the drill bit may be altered by changing the direction in which drilling fluid exits the nozzle. Of course, the size of one or more nozzles and the direction of one or more nozzles may be changed to provide the drill bit with a desired balance characteristic or moment configuration.

The present invention also includes methods of configuring the hydraulics of a rotary-type earth-boring drill bit to impart the drill bit with a desired moment configuration or balance characteristic, a method of disposing a nozzle on a drill bit to alter the moment configuration or balance characteristic of the drill bit, and a method of designing a drill bit to have a desired moment configuration or balance characteristic. Each of the foregoing methods include evaluating, or predicting or monitoring, one or more characteristics of the drill bit hydraulics, such as the weight of the drilling fluid, the flow rate of the drilling fluid through the drill string and bit into the borehole, the effect on the balance characteristic or moment configuration as a jet of drilling fluid exits the drill bit and hits the wall of the borehole at a non-perpendicular lateral angle, and the effect of cutting element-induced force vectors on the balance characteristic or moment configuration of the drill bit. Each of the methods of the present invention may also include varying the flow of drilling fluid through the drill bit in a controlled manner, such as by pulsing the drilling fluid through the drill bit.

Other advantages of the present invention will become apparent to those of skill in the art through consideration of the ensuing description, the accompanying drawings, and the appended claims.

DETAILED DESCRIPTION OF THE PREFERRED EMBODIMENTS

Figure 4:
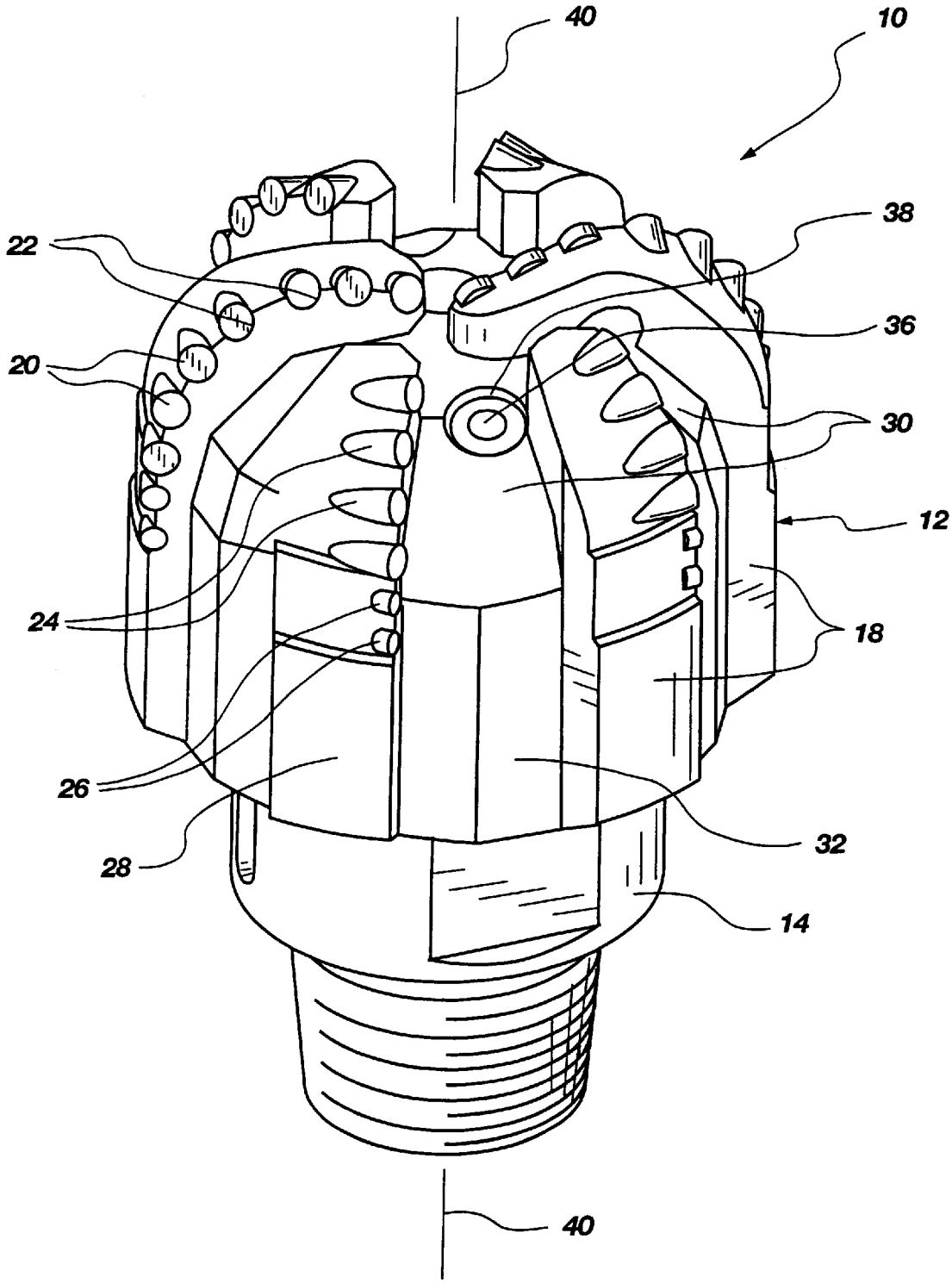
FIG. 4 is a perspective view of a drill bit of the present invention.
Figure 5:
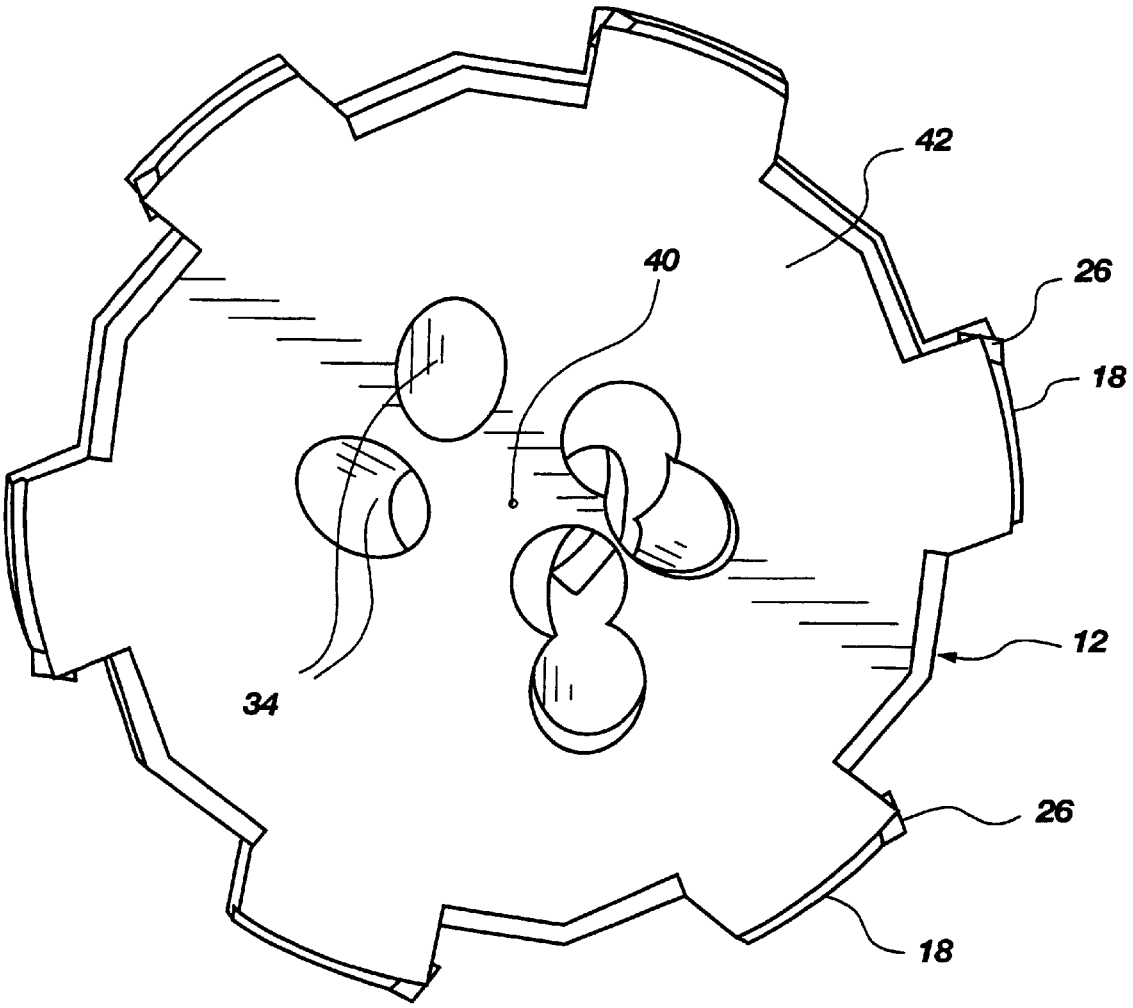
FIG. 5 is a top elevation of an exposed slice or layer of the drill bit of FIG. 4, taken transverse to the longitudinal axis thereof.

FIGS. 4 and 5 illustrate an exemplary drill bit 10 that includes nozzles 36 that are positioned, oriented and sized to impart the bit with the desired balance characteristic or moment configuration Drill bit 10, as shown, includes a variety of external and internal components, such as a bit body 12 that includes six blades or wings 18 and gage pads 28 at the periphery of the bit body. Blades 18 are separated by generally radially extending fluid courses 30, which are continuous with junk slots 32 positioned between gage pads 28. Fluid courses 30 are continuous with internal fluid passages 34.

In operation, junk slots 32 are provided with drilling fluid from the drill string through shank 14, which communicates with internal fluid passages 34. A quantity of drilling fluid exits internal fluid passages 34 through nozzles 36, which are disposed in cavities 38, defined in fluid courses 30, and is directed along the fluid courses 30 to junk slots 32.

At the distal end of the bit body 12, blades 18 include sockets 22 with inclined rear buttresses 24. Sockets 22 carry cutting elements 20, which are supported from behind by buttresses 24. Gage trimmers 26 are set immediately adjacent and above (as depicted in FIG. 4) gage pads 28. Blades 18, fluid courses 30, and the topographical details thereof collectively define what may be termed the "bit face", being the surface of the bit which contacts the undrilled formation at the bottom of the borehole. The exterior shape of a diametrical cross section of the bit body 12, taken along the longitudinal bit axis 40, defines what may be termed the bit, or "crown", profile.

Bit body 12 may be formed by known techniques, such as by the use of a particulate or powdered material, such as a refractory material (e.g., a carbide, such as tungsten carbide, titanium carbide, tantalum carbide, etc.); a tough and ductile material (e.g., iron, steel, or Invar); or ceramic. The powdered material may be shaped to form bit body 12 by techniques that are known in the art, including, without limitation, by disposing the powdered material into a mold; by processes which employ a matrix displacing material, such as those disclosed in U.S. Pat. No. 5,090,491, which issued to Tibbitts et al. on Feb. 25, 1992, the disclosure of which is hereby incorporated by reference in its entirety; or by the layered-manufacturing processes that are disclosed in U.S. Pat. No. 5,433,280, which issued to Smith on Jul. 18, 1995, the disclosure of which is hereby incorporated by reference in its entirety. Preferably, the matrix displacing material is a tough and ductile material of a type known in the art (e.g., copper-based alloys). A bit body 12 that may be fabricated by each of these processes comprises a somewhat porous and permeable matrix, akin to a sponge or an open-celled foam. Consequently, the matrix of powdered material is relatively weak, as powdered material may be easily mechanically removed from the matrix. Accordingly, in order to form a finished drill bit 10, such as that depicted in FIGS. 4 and 5, it is necessary to infiltrate the matrix with a binder material (e.g., a copper-, nickel-, cobalt- or iron-based alloy), as known in the art. Alternatively, bit body 12 may be machined from a tough, strong material, such as steel, also as known in the art.

Figure 1:
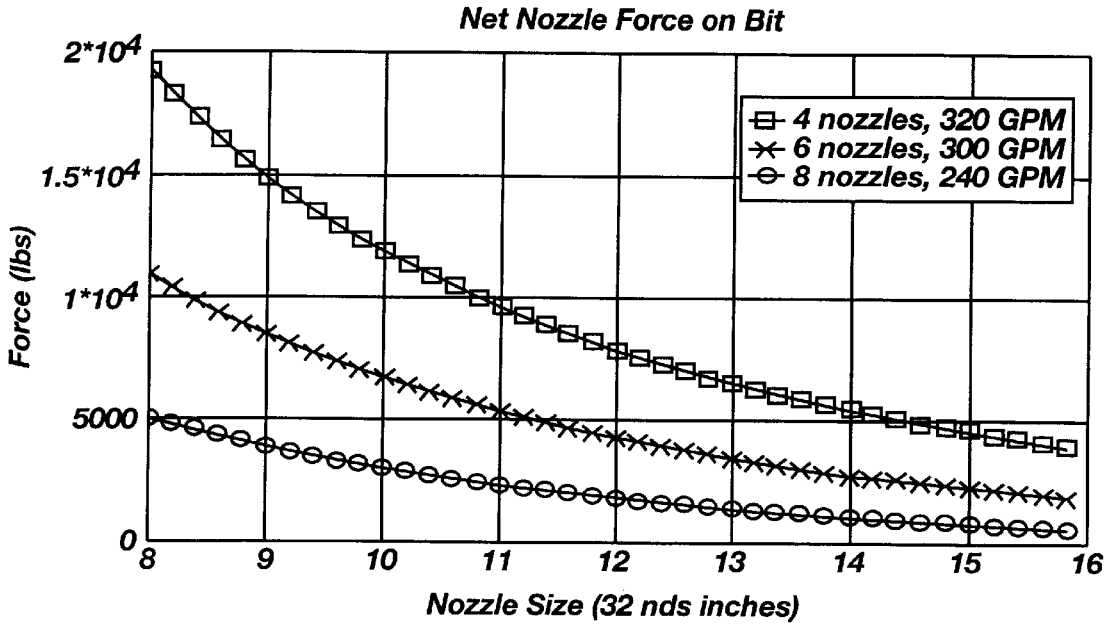
FIG. 1 is a line graph that illustrates the net hydraulic forces on rotary-type earth-boring drill bits having 4, 6, or 8 nozzles of various sizes as drilling fluid having a weight of 12 lbs/gallon flows through the nozzles at 320 GPM, 300 GPM and 240 GPM, respectively.
Figure 2:
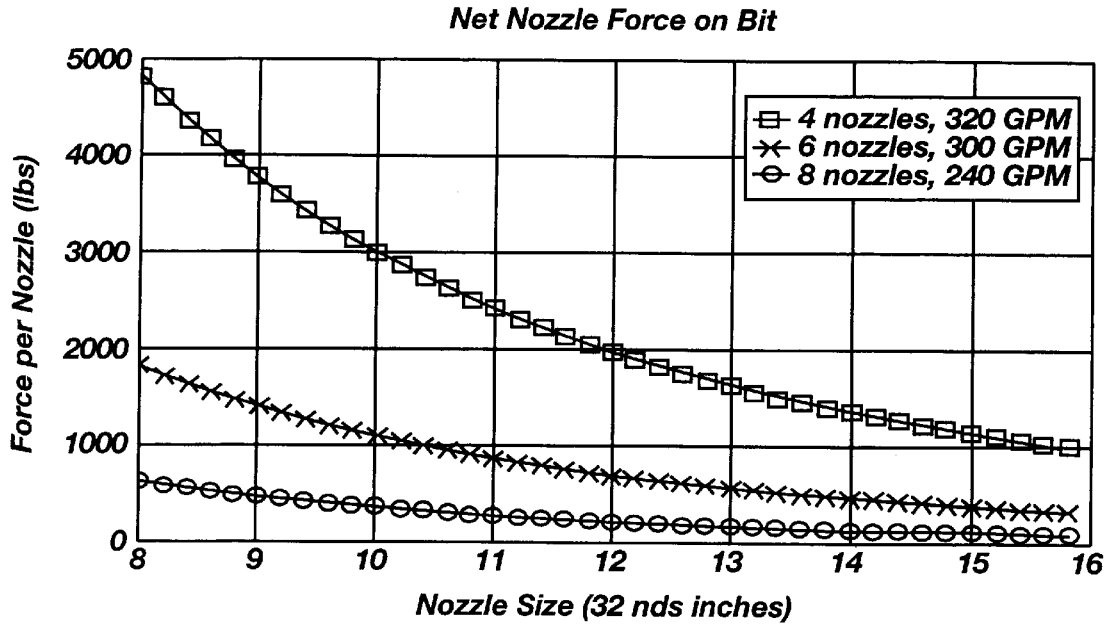
FIG. 2 is a line graph that illustrates the per-nozzle hydraulic force exerted on the rotary-type earth-boring drill bits of FIG. 1 with the same weight, rate, and nozzle number and size variables as depicted in FIG. 1.
Figure 3:
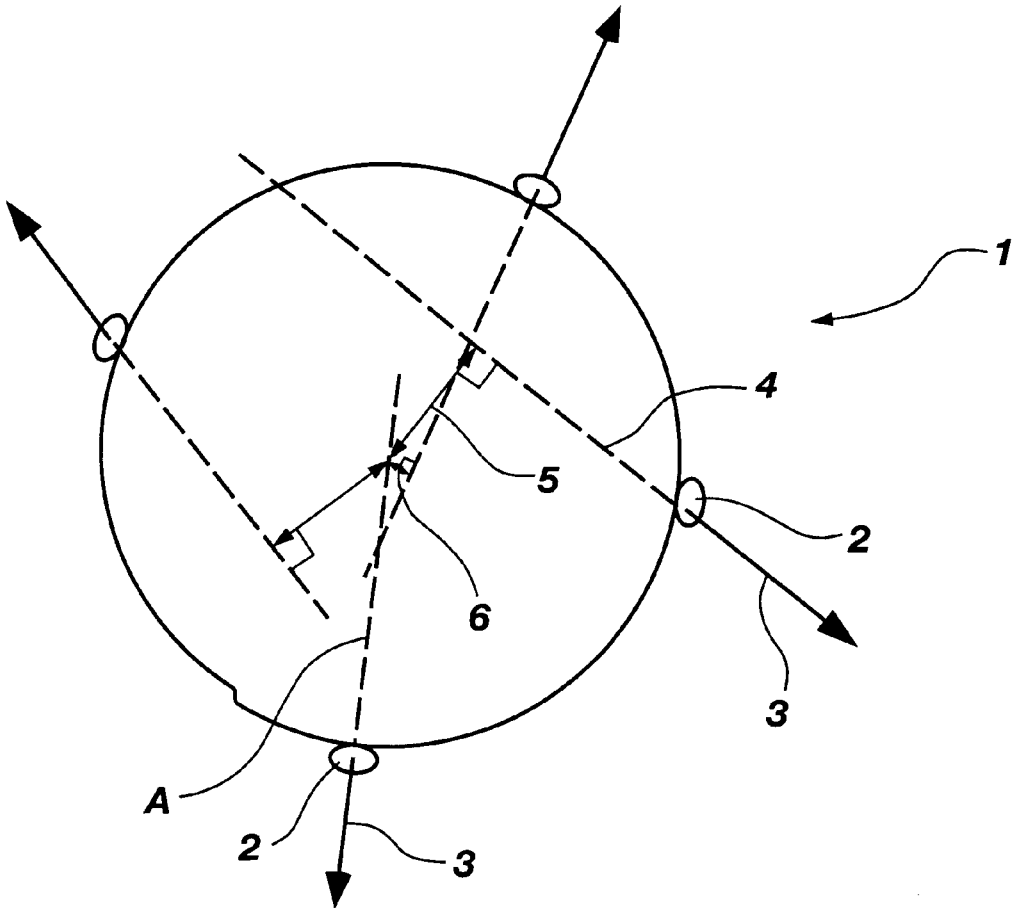
FIG. 3 is a schematic representation of the moment configuration of a drill bit.

Typically, the nozzles 36 of a state of the art drill bit 10 are removably secured to the drill bit by known means, such as threading, snap-fitting, or spring-loading. Thus, a nozzle 36 may be removed from drill bit 10 on the drilling rig and replaced with a nozzle of different size to vary the hydraulic force exerted on a particular portion of the drill bit by drilling fluid flowing therefrom, as illustrated in the graph of FIG. 2.

Nozzles 36 of drill bit 10 may be adjustable to a variety of orientations. The re-directing of a nozzle 36 changes the direction in which drilling fluid flows from drill bit 10 and, thus, the direction in which the hydraulic force of the drilling fluid is exerted on drill bit 10. Exemplary variable orientation nozzles that may be used on drill bit 10 of the present invention are disclosed in U.S. Pat. No. 4,533,005, which issued to Morris on Aug. 6, 1985, and U.S. Pat. No. 4,794,995, which issued to Matson et al. on Jan. 3, 1989, the disclosures of each of which are hereby incorporated by reference in their entirety.

Figure 6:
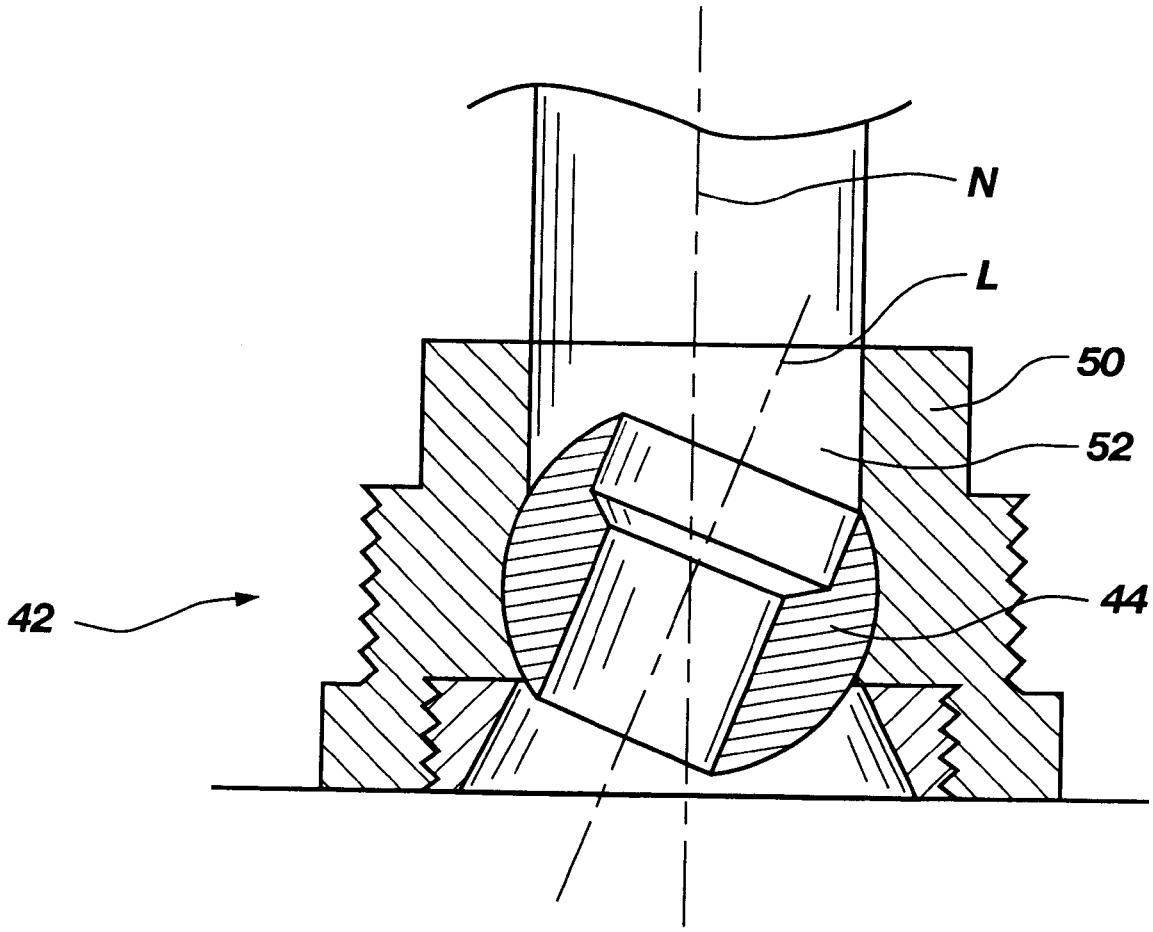
FIG. 6 is a cross-sectional view of a variable orientation nozzle that is useful on the drill bit of the present invention.

Alternatively, other variable orientation nozzles may be employed on drill bit 10, such as the nozzle 42 depicted in FIG. 6, which includes a spherical nozzle body 44 and a housing 50, which includes a nozzle orifice 52, that secures nozzle body 44. The longitudinal axis L of nozzle 42 may be changed with respect to the longitudinal axis N of nozzle orifice 52 by rotating or tilting the nozzle 42 relative to housing 50.

In utilizing or organizing the hydraulics of drill bit 10 to impart the drill bit with a desired balance characteristic or moment configuration, the size, number, orientation and positioning of nozzles 36, the weight and flow rate of drilling fluid, and the lateral angle at which a jet of drilling fluid hits the borehole wall should be considered, as each of these properties affects the hydraulic forces that are exerted on drill bit 10 as drilling fluid flows therefrom. In addition, the cutting element-induced force vectors that are exerted on drill bit 10 as cutting elements 20 (see FIG. 4) cut into a formation should also be considered in imparting drill bit 10 with a desired balance characteristic or moment configuration, as these cutting element-induced force vectors affect the balance and moment configuration of the drill bit.

Figure 7:
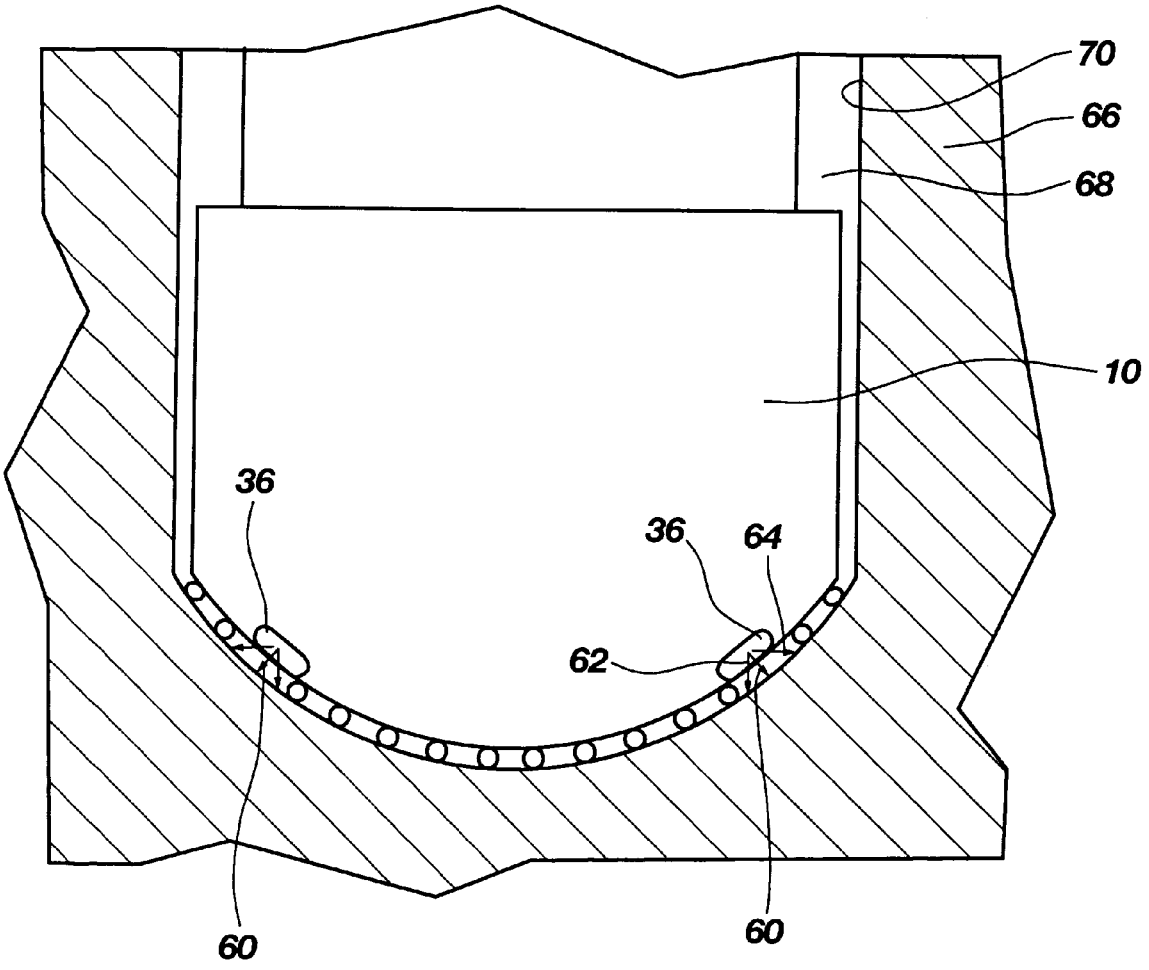
FIG. 7 is a cross-sectional schematic representation of a drill bit in a borehole, taken diametrically to a longitudinal axis of the drill bit and illustrating the axial and lateral components of the hydraulic direction vector as drilling fluid exits the drill bit.

Referring now to FIG. 7, a drill bit 10 in a borehole 68 of a formation 66 is illustrated. The direction, or hydraulic direction vector 60, of drilling fluid that exits drill bit 10 through each nozzle 36 is illustrated by a diagonal arrow. Each hydraulic direction vector 60 has an axial component 62, illustrated by small vertical arrows, and a lateral component 64, illustrated by small horizontal arrows. Each of the axial 62 and lateral 64 components of hydraulic direction vector 60 also has an associated magnitude of force. The axial component 62 of each of the hydraulic direction vectors of the drilling fluid tends to exert an upward hydraulic, reactive force on drill bit 10 and the drill string (not shown) to which the drill bit is attached. The hydraulic force vector, which is substantially opposite the corresponding hydraulic direction vector 60, also has axial and lateral components that are substantially opposite the axial and lateral components, respectively, of hydraulic direction vector 60. The axial component of the hydraulic force vector may be compensated for, in most instances, by increasing the WOB. The lateral component of the hydraulic force vector may, however, affect the overall rotational balance characteristic or moment configuration of drill bit 10. Similarly, the hydraulic force vector may affect the balance or moment of the drill bit along the z-axis thereof.

Figure 8:
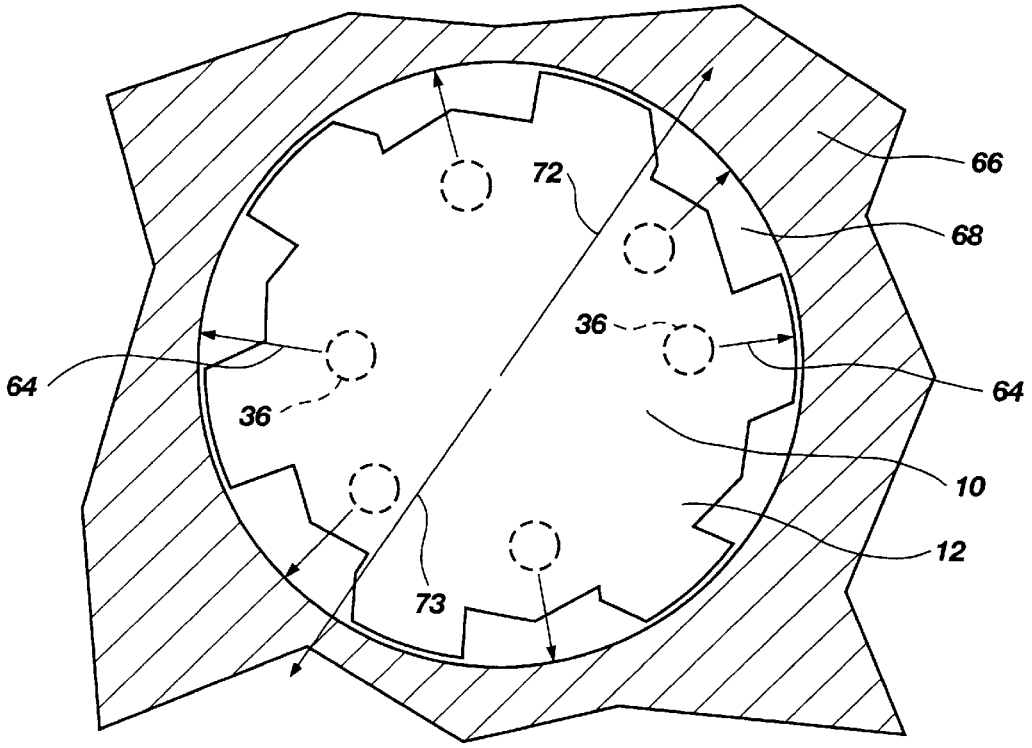
FIG. 8 is a cross-sectional schematic representation of a drill bit in a borehole, taken transverse to a longitudinal axis of the drill bit and illustrating the lateral component of the hydraulic direction vector as drilling fluid exits the drill bit.

FIG. 8 is a cross-sectional schematic representation of drill bit 10 in a borehole 68, which illustrates the lateral components 64 of the hydraulic direction vector of drilling fluid exiting the drill bit at various locations. The lateral component 64 of the hydraulic direction vector of drilling fluid exiting through each nozzle 36 of drill bit 10 is represented by a small arrow. The net direction of the combined hydraulic direction vectors, and the net magnitude of combined hydraulic forces of the drilling fluid exiting drill bit 10, are collectively referred to as a net hydraulic direction vector 72, which is represented by a large arrow. The hydraulic force of drilling fluid exiting drill bit 10 causes a substantially opposite reactive force, which is represented as a net hydraulic force vector 73. Because the illustrated drill bit 10 is a so-called "balanced" drill bit, net hydraulic force vector 73 also represents a balance characteristic vector or net imbalance of drill bit 10.

A drill bit 10 according to the present invention may include one or more nozzles 36 that are oriented on the bit body 12 to balance the hydraulic forces acting upon the drill bit. Stated another way, the hydraulic forces may offset each other so that there is no significant or measurable hydraulic force vector and no corresponding reactive forces on drill bit 10. Accordingly, in a balanced drill bit 10, such as that depicted in FIG. 8, at least two nozzles 36 may be placed on the bit and mutually oriented in a manner which substantially balances the hydraulic forces of drilling fluid on the drill bit so that the hydraulic forces do not substantially affect the balance characteristic or moment configuration of the drill bit. Alternatively, the drill bit hydraulics may be employed to alter the balance characteristic or moment configuration of drill bit 10 to compensate for other imbalance forces, such as those induced by the cutting elements, blades, or lateral bearing surfaces of the drill bit. For example, at least one nozzle 36 may be disposed on drill bit 10 to alter a characteristic of the drill bit, such as creating or altering a net imbalance of the drill bit.

Various other factors that may be considered in achieving the desired net hydraulic force vector as drilling fluid exits the drill bit include, without limitation, the weight and flow rate of the drilling fluid, the nozzle sizes and the lateral angle at which a jet of drilling fluid hits the wall of the borehole.

Figure 9:
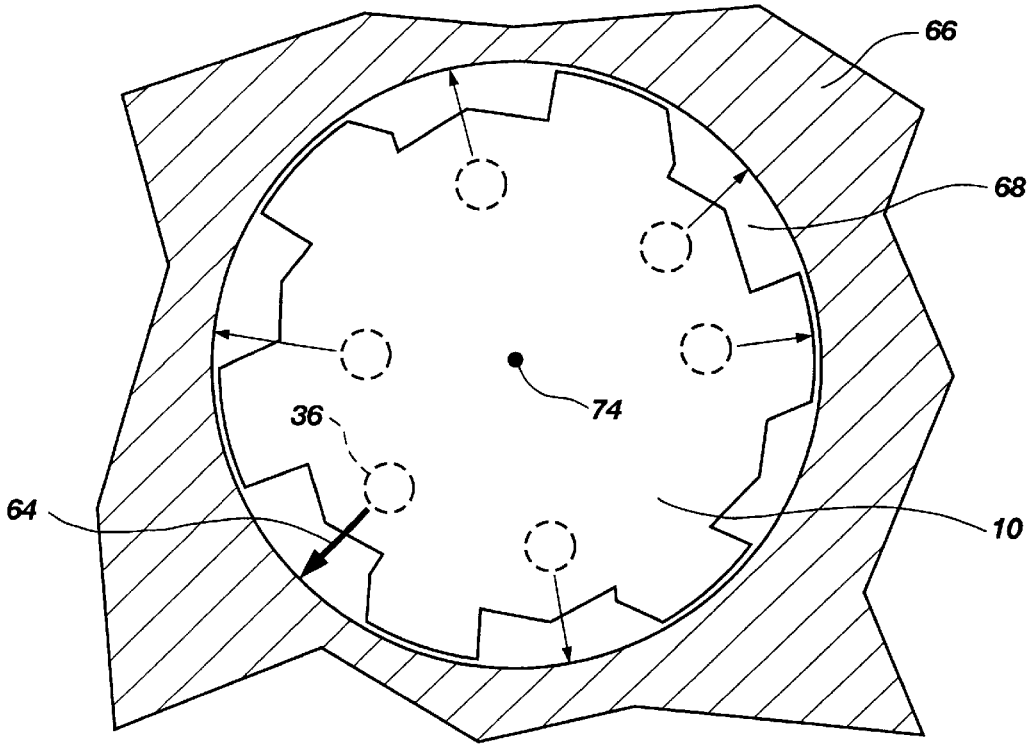
FIG. 9 is a cross-sectional schematic representation of a drill bit in a borehole, taken transverse to the longitudinal axis of the drill bit and illustrating a variation in the size of a nozzle to change the balance characteristic or moment configuration of the drill bit.

As shown in FIG. 9, the direction of net hydraulic force vector 73 may be altered from that depicted in FIG. 8, or the magnitude of force along the net hydraulic force vector 73 substantially eliminated by replacing at least one of the nozzles 36 through which drilling fluid exits the drill bit with a differently sized nozzle. FIG. 9 depicts adjusting of the hydraulics of drill bit 10 to offset and effectively eliminate net hydraulic force vector 73, which places the moment of rotation 74 of drill bit 10 substantially at the center thereof. Stated another way, the hydraulics of drill bit 10 are organized so that the hydraulic force exerted on drill bit 10 as drilling fluid exits each nozzle 36 is offset by the combined hydraulic force exerted on drill bit 10 as drilling fluid exits the other nozzles 36. Accordingly, there is substantially no net hydraulic direction vector 72 or net hydraulic force vector 73. The amount of net hydraulic force along net hydraulic force vector 73 (and, therefore, the magnitude of hydraulic flow along net hydraulic direction force vector 72) may also be varied by replacing one or more nozzles 36 with a nozzle of different size to change the magnitude of hydraulic flow along the lateral components 64 of one or more of hydraulic direction vectors 60 (see FIG. 7).

Figure 10:
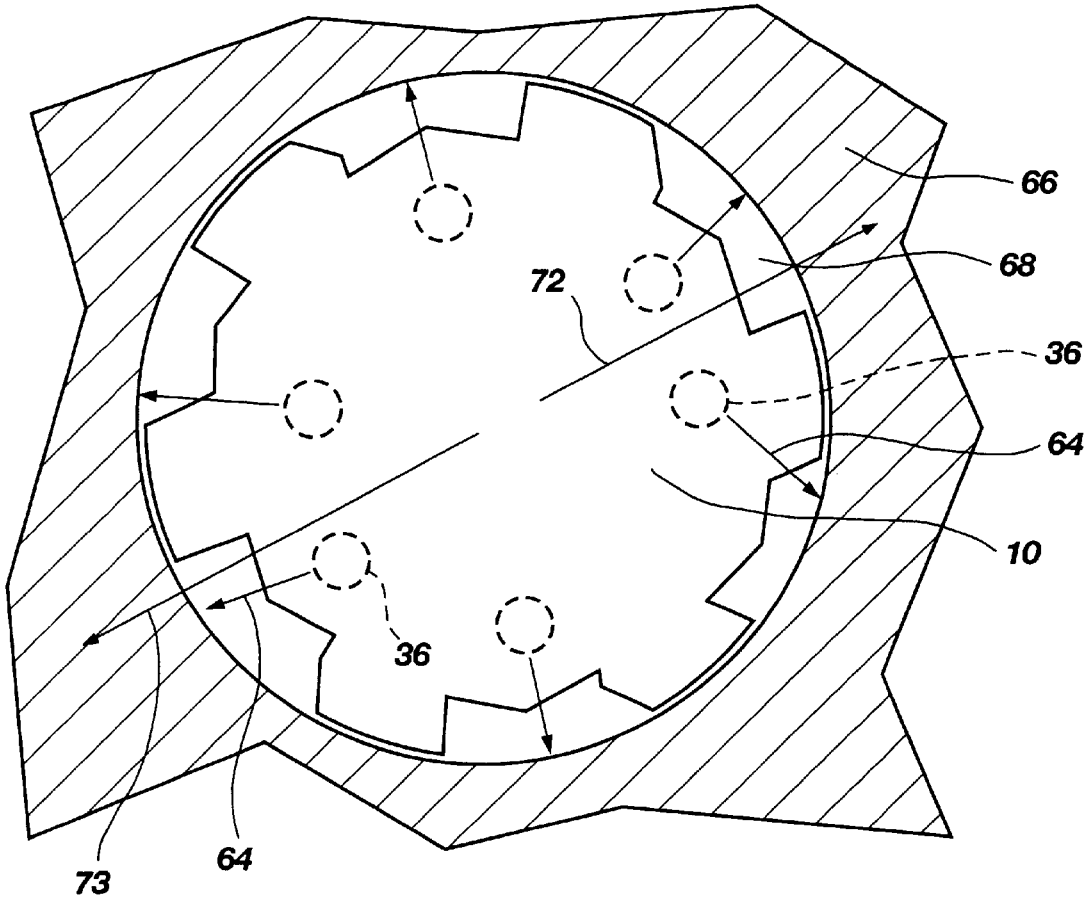
FIG. 10 is a cross-sectional schematic representation of a drill bit in a borehole, taken transverse to the longitudinal axis of the drill bit and illustrating a variation in the direction in which a nozzle directs drilling fluid in order to change the balance characteristic or moment configuration of the drill bit.

FIG. 10 represents an alteration of the net direction of net hydraulic direction vector 72 and net hydraulic force vector 73 by altering the direction in which one or more of nozzles 36 direct drilling fluid from drill bit 10. Similarly, the amount of net hydraulic force along net hydraulic force vector 73 (and, therefore, the magnitude of hydraulic flow along net hydraulic direction vector 72) may be altered by redirecting one or more of nozzles 36.

Of course, the net direction of each of net hydraulic direction vector 72 and net hydraulic force vector 73 and the amount of flow and forces along vectors 72 and 73 may also be varied by replacing at least one of nozzles 36 with a differently sized nozzle and changing the direction of one or more of nozzles 36.

Figure 11:
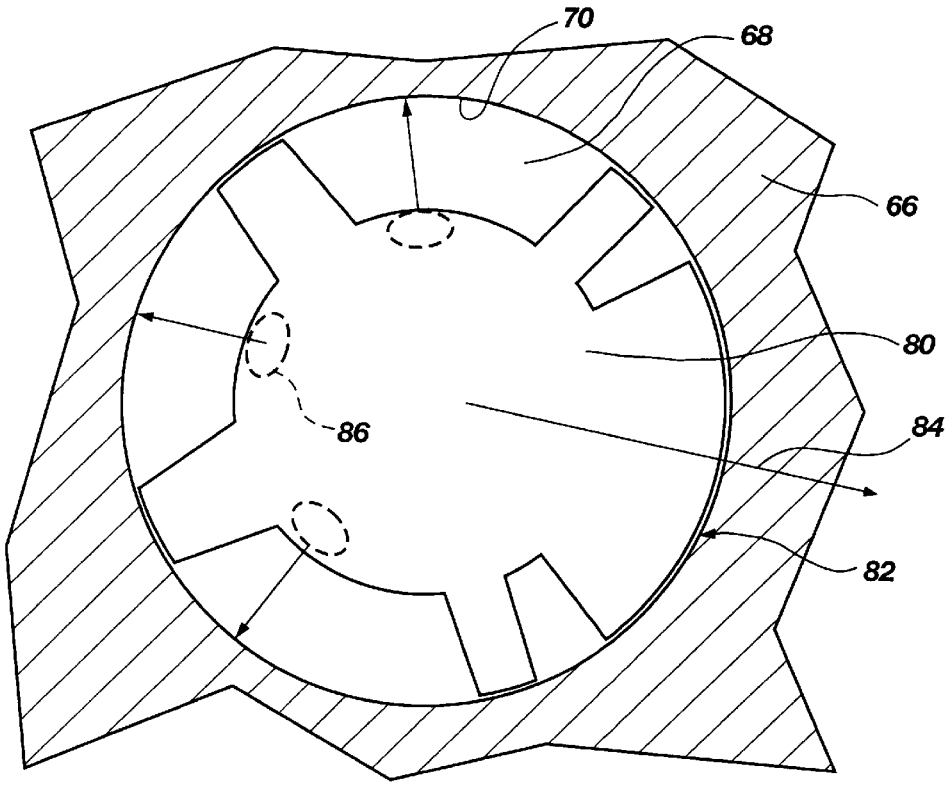
FIG. 11 is a cross-sectional schematic representation of a net imbalance drill bit in which the net imbalance forces direct too much force against a wall of the borehole and decrease the useful life of the drill bit.
Figure 12:
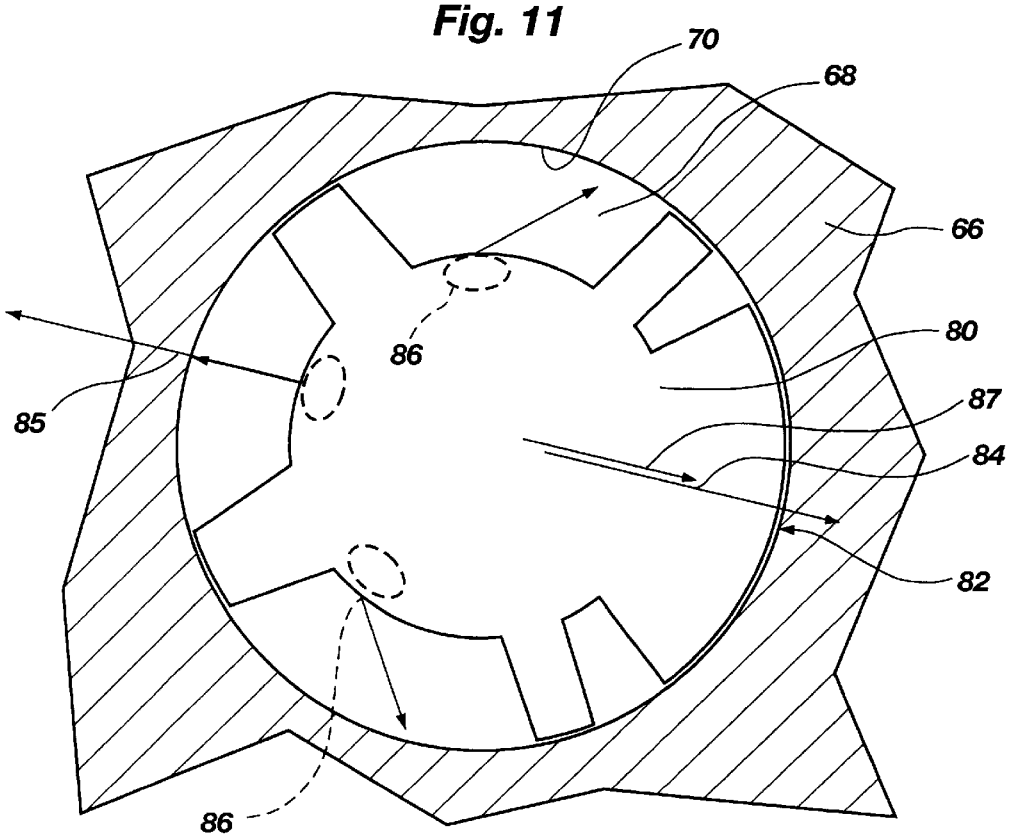
FIG. 12 is a cross-sectional schematic representation of the drill bit of FIG. 11, in which the drill bit hydraulics are utilized to reduce the net imbalance force.

FIGS. 11 and 12 depict a first embodiment of a process of the present invention for tailoring the net overall force balance characteristic or moment configuration of a net imbalance drill bit 80.

FIG. 11 illustrates a net force imbalance drill bit 80 including a low friction bearing zone 82 on the face thereof. Drill bit 80 is disposed on the end of a drill string (not shown) within a borehole 68 of a formation 66. The net imbalance force, or balance characteristic vector 84, represented by a large arrow, of drill bit 80 is more than adequate to maintain low friction bearing zone 82 in contact with the wall 70 of borehole 68 and prevent bit whirl. Thus, the force of low friction bearing zone 82 against wall 70 will cause the low friction bearing zone to wear at an undesirably high rate, which effectively shortens the useful life of drill bit 80.

FIG. 12 illustrates the variation of the hydraulic forces to create a net hydraulic force vector 85, represented by an arrow, exerted on drill bit 80 as drilling fluid exits therefrom, which is substantially opposite a net hydraulic direction vector 87 of drilling fluid exiting drill bit 80, by replacing or re-orienting nozzles 86, in the manner discussed above in reference to FIGS. 9 and 10, to counteract the undesirably high net imbalance force illustrated in FIG. 11, represented by balance characteristic vector 84, along which low friction bearing zone 82 exerts force against wall 70. Thus, the magnitude of flow and direction of drilling fluid exiting drill bit 80 from one or more locations, which are collectively represented by the arrow of net hydraulic direction vector 87, may be varied to decrease the net imbalance of drill bit 80 without altering the net direction of balance characteristic vector 84. Stated another way, the hydraulic forces exerted on drill bit 80 as drilling fluid exits the drill bit may be varied in such a manner that net hydraulic force vector 85 is directed opposite balance characteristic vector 84. Conversely, when the net imbalance forces of a drill bit 80 are insufficient to maintain substantially continuous contact of low friction bearing zone 82 with wall 70 of borehole 68, the hydraulic forces caused by drilling fluid may be utilized to increase the net imbalance of the drill bit, and thereby prevent whirl of drill bit 80 in borehole 68. The direction of net imbalance forces may also be altered in a similar manner.

Figure 13:
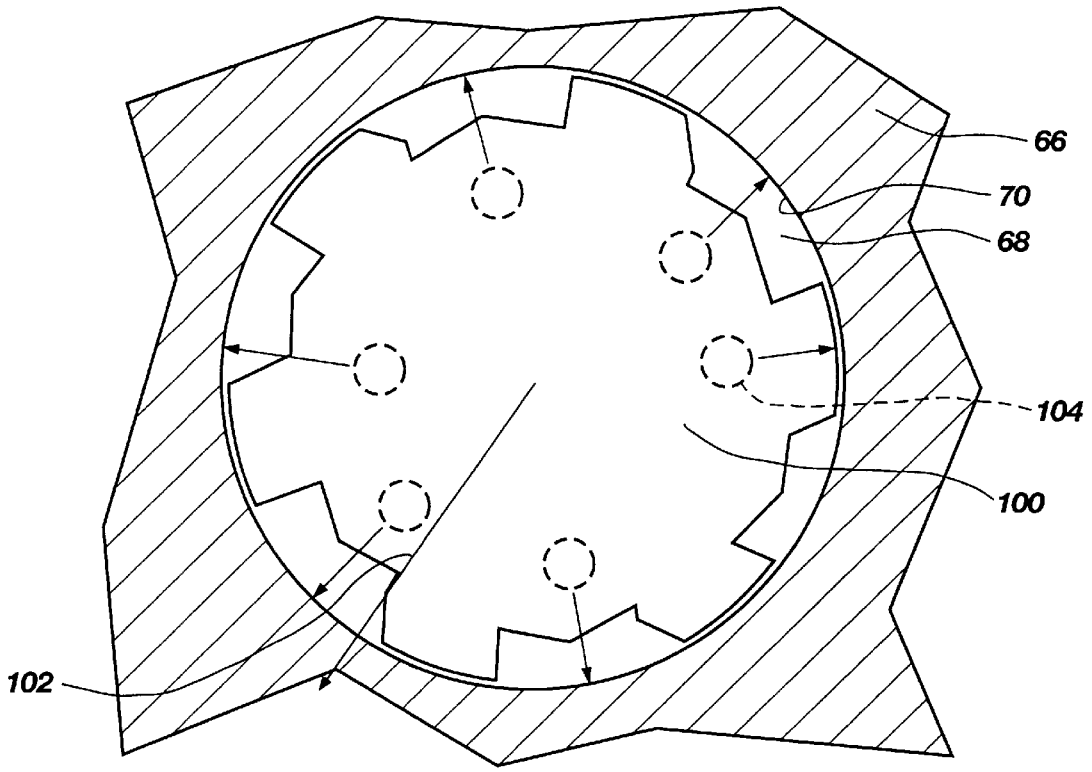
FIG. 13 is a cross-sectional schematic representation of a so-called "balanced" drill bit, in which the drill bit hydraulics may create a net imbalance during rotation of the drill bit.
Figure 14:
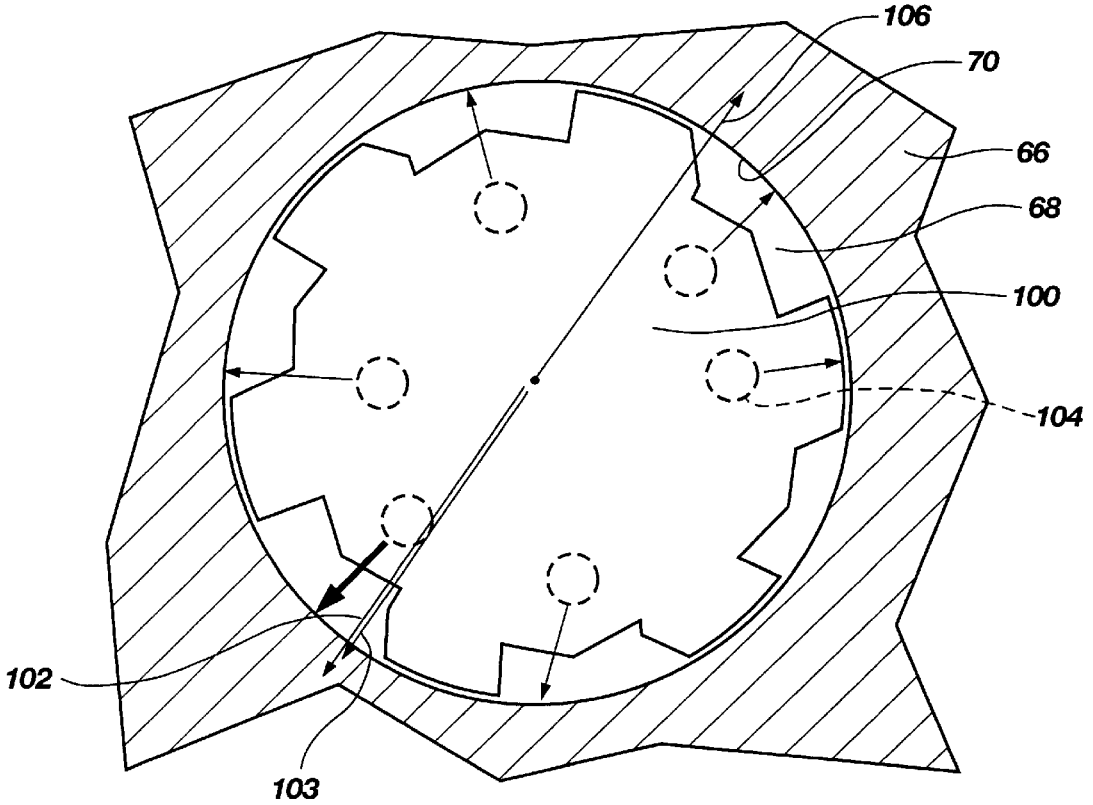
FIG. 14 is a cross-sectional schematic representation of the drill bit of FIG. 13, in which the drill bit hydraulics are adjusted to reduce or eliminate the net imbalance.

FIGS. 13 and 14 illustrate a second embodiment of the tailoring process of the present invention, which is useful for tailoring the balance characteristic or moment configuration of a so-called "balanced force" drill bit 100.

FIG. 13 illustrates a "balanced force" drill bit 100, which has an actual slight net imbalance, represented by the balance characteristic vector 102 arrow, which may be caused by the collective hydraulic forces exerted on drill bit 100 as drilling fluid exits nozzles 104 of drill bit 100. The imbalance may be caused by the use of nozzles of different sizes on drill bit 100, or by the placement or orientation of nozzles 104 on the drill bit in a manner that creates imbalance of the drill bit during use. Alternatively, the imbalance may be caused by or attributable to an imbalance of other components of drill bit 100 (e.g., the cutting elements, blades, lateral bearing surfaces, etc.). As is known to those in the art, however, even small amounts of imbalance in balanced drill bits is undesirable since such imbalance may cause the drill bit to whirl.

FIG. 14 illustrates a modification of the drill bit illustrated in FIG. 13, in which the direction of one or more of nozzles 104 has been varied or one or more nozzles 104 has been replaced with a differently sized nozzle, as described above in reference to FIGS. 9 and 10, to counteract the net imbalance, represented by balance characteristic vector 102, of drill bit 100. Accordingly, the direction or magnitude of the individual drilling fluid jets may be varied to create a collective, or net, hydraulic direction vector 103 in substantially the same direction and of substantially the same magnitude as balance characteristic vector 102. The collective flow of drilling fluid along net hydraulic direction vector 103 generates a net hydraulic force vector 106, which counteracts balance characteristic vector 102, imparting drill bit 100 with the desired amount of balance.

Since the orientation of nozzles may be changed and the nozzles of a drill bit replaced with differently sized nozzles on-site, the hydraulics of a drill bit may be modified in accordance with the method of the present invention to accommodate different weights and flow rates of drilling fluid, as well as different types of formations and cutting elements, in order to provide a the drill bit with the desired balance characteristic or moment configuration. The method of the present invention may also be employed in conjunction with on-site evaluation of the balance of a drill bit to adjust the balance characteristic or moment configuration of the drill bit or to correct drill bit balance problems that may be encountered during use of the drill bit, so as to increase the rate of drilling, as well as the useful life of the drill bit. Such on-site evaluation may be performed by monitoring the drill bit during drilling or by means of predictive mathematical modeling.

Predictive mathematical modeling considers the placement, number, size and orientation of the nozzles to be used on the drill bit; the weight and flow rate of the drilling fluid to be introduced into the borehole through the nozzles; and the size, placement and configuration of other features of the bit, such as the blades, cutting elements and lateral bearing surfaces thereof to predict the net balance (or imbalance) force and moment of the drill bit. Nozzles may then be removed from the drill bit, added thereto, re-oriented, or replaced with differently sized nozzles, or the drilling fluid replaced with a drilling fluid of different weight to impart the drill bit with a desired balance characteristic or moment configuration.

Alternatively, a desired balance characteristic or moment configuration may be determined and mathematical modeling employed to provide alternative drill bit configurations, including the number, size and orientation of nozzles on the drill bit, and the weights and flow rates of drilling fluid that may be used with the drill bit in order to achieve the desired balance characteristic or moment configuration. As another alternative, existing bit designs may be evaluated by mathematical modeling that predicts the balance characteristic or moment configuration thereof. Such bit designs may then be altered by rearranging the placement, sizing, configuration and/or orientation of the various elements, such as the nozzles, blades, lateral bearing surfaces and cutting elements, of the drill bit.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced within their scope.

What is claimed is:

1. A method of altering a moment configuration of a rotary-type earth-boring drill bit, comprising:

predicting the moment configuration of the drill bit during drilling by mathematically modeling;

evaluating the moment configuration; and modifying a drilling fluid flow characteristic of the drill bit based at least in part on said evaluating.

2. The method of claim 1, wherein said modifying said drilling fluid flow characteristic comprises replacing at least one nozzle of the drill bit with a differently sized nozzle.

3. The method of claim 1, wherein said modifying said drilling fluid flow characteristic comprises changing an orientation of at least one nozzle of the drill bit to alter a direction in which a quantity of drilling fluid flows from said at least one nozzle.

4. The method of claim 1, wherein said mathematical modeling comprises mathematically modeling rotation of the drill bit.

5. The method of claim 1, further comprising evaluating an effect of a jet of a quantity of drilling fluid on the moment configuration as said jet contacts a surface of a borehole of a formation.

6. The method of claim 1, wherein said evaluating is based on a weight of a quantity of drilling fluid to flow through the drill bit.

7. The method of claim 1, wherein said evaluating is based on a rate at which a quantity of drilling fluid flows through the drill bit.

8. A method of altering a balance characteristic vector of a rotary-type earth-boring drill bit, comprising:

evaluating the balance characteristic vector by mathematically modeling rotation of the drill bit to predict the balance characteristic vector of the drill bit; and modifying a net hydraulic force vector of a quantity of drilling fluid flowing from the drill bit based at least in part on said evaluating.

9. The method of claim 8, wherein said modifying said net hydraulic force vector comprises replacing at least one nozzle of the drill bit with a differently sized nozzle.

10. The method of claim 8, wherein said modifying said net hydraulic force vector comprises changing a direction in which a quantity of drilling fluid flows from at least one nozzle of the drill bit.

11. The method of claim 8, wherein said modified net hydraulic force vector offsets the balance characteristic vector.

12. The method of claim 8, wherein said modified net hydraulic force vector enhances the balance characteristic vector.

13. The method of claim 8, wherein said modified net hydraulic force vector alters a direction of the balance characteristic vector.

14. A method of altering a balance characteristic of a rotary-type earth-boring drill bit, comprising:

evaluating an effect of cutting element-induced force vectors on a moment configuration of the drill bit by mathematical modeling to predict said effect of said cutting element-induced force vectors on the moment configuration; and changing the moment configuration by:

selecting at least one nozzle sized to provide a particular hydraulic force on a portion of the drill bit as drilling fluid flows through said at least one nozzle; and orienting said at least one nozzle to orient said particular hydraulic force against said drill bit portion in a particular direction.

15. The method of claim 14, further comprising evaluating an angle at which a jet of a quantity of a drilling fluid material contacts a surface of a borehole of a formation.

16. The method of claim 14, further comprising altering a weight of a quantity of drilling fluid to flow through the drill bit.

17. The method of claim 14, further comprising altering a rate of a quantity of drilling fluid to flow through the drill bit.

18. A method of refining a moment configuration of a rotary-type earth-boring drill bit, the method comprising:

predicting an angle at which a jet of a quantity of a drilling fluid will contact a surface of a borehole of a formation to be drilled during drilling to predict an initial moment configuration of the drill bit during drilling of a formation;

comparing said initial moment configuration to a desired moment configuration;

configuring a nozzle organization to adjust the drill bit from said initial moment configuration to said desired moment configuration;

selecting at least one nozzle based at least in part on said comparing and said configuring said nozzle organization; and disposing said at least one nozzle on the drill bit.

19. The method of claim 18, wherein said configuring said nozzle organization comprises altering a weight of a quantity of drilling fluid to flow through said at least one nozzle.

20. The method of claim 18, wherein said configuring said nozzle organization comprises altering a flow rate of a quantity of drilling fluid to flow through said at least one nozzle.

21. The method of claim 18, wherein said predicting comprises predicting at least one cutting element-induced vector as at least one cutting element of the drill bit cuts said formation.

22. The method of claim 18, wherein said configuring said nozzle organization comprises orienting the at least one nozzle to direct a quantity of drilling fluid in a direction to impart the drill bit with said desired moment configuration.

23. The method of claim 18, wherein said selecting the at least one nozzle comprises selecting the at least one nozzle on a basis of size.

24. A method of configuring a hydraulic organization of a rotary-type earth-boring drill bit, the method comprising:

determining an initial moment configuration of the drill bit;

selecting a desired moment configuration of the drill bit;

evaluating an effect of a surface of a borehole of a formation adjacent the drill bit said desired moment configuration and at least one cutting element-induced force vector as at least one cutting element of the drill bit cuts said formation to determine a hydraulic force vector of at least one nozzle of the drill bit required to adjust the drill bit from said initial moment configuration to said desired moment configuration; and configuring an orientation of said at least one nozzle to bring a moment configuration of the drill bit closer to said desired moment configuration.

25. The method of claim 24, wherein said evaluating said hydraulic force vector comprises evaluating a weight of a quantity of drilling fluid to flow through said at least one nozzle.

26. The method of claim 24, wherein said evaluating said hydraulic force vector comprises evaluating a flow rate of a quantity of drilling fluid to flow through said at least one nozzle.

27. The method of claim 24, wherein said evaluating said effect comprises evaluating said effect of said surface on a hydraulic force vector of a quantity of drilling fluid exiting the drill bit.

28. The method of claim 24, further comprising selecting said at least one nozzle on a basis of size.

29. The method of claim 24, further comprising configuring an orientation of said at least one nozzle.

30. A method of refining a moment configuration of a rotary-type earth-boring drill bit, the method comprising:

predicting an initial moment configuration of the drill bit during drilling of a formation;

comparing said initial moment configuration to a desired moment configuration;

configuring a nozzle organization to adjust the drill bit from said initial moment configuration to said desired moment configuration;

selecting at least one nozzle based at least in part on said comparing and said configuring said nozzle organization;

orienting said at least one nozzle to direct a quantity of drilling fluid in a direction to impart the drill bit with said desired moment configuration; and disposing said at least one nozzle on the drill bit.

31. A method of configuring a hydraulic organization of a rotary-type earth-boring drill bit, the method comprising:

determining an initial moment configuration of the drill bit;

selecting a desired moment configuration of the drill bit;

evaluating a hydraulic force vector of at least one nozzle of the drill bit required to adjust the drill bit from said initial moment configuration to said desired moment configuration; and configuring an orientation of said at least one nozzle.

* * * * *

UNITED STATES PATENT AND TRADEMARK OFFICE

CERTIFICATE OF CORRECTION

PATENT NO. : 6,186,251 B1
DATED : February 23, 2001
INVENTOR(S) : Trent N. Butcher It is certified that error appears in the above-identified patent and that said Letters Patent is hereby corrected as shown below:

Column 5,
Line 44, insert a period after "configuration"

Column 9,
Line 57, before "drill" delete "the"

Signed and Sealed this

Tenth Day of June, 2003

JAMES E. ROGAN
*Director of the United States Patent and Trademark Office*